US009842681B2

(12) United States Patent
Hasegawa et al.

(10) Patent No.: US 9,842,681 B2
(45) Date of Patent: Dec. 12, 2017

(54) LITZ WIRE COIL

(71) Applicant: SWCC SHOWA DEVICE TECHNOLOGY CO., LTD., Tokyo (JP)

(72) Inventors: Shirou Hasegawa, Tokyo (JP); Masahiro Mori, Tokyo (JP); Tatsuya Iijima, Tokyo (JP); Kiyoshi Miura, Tokyo (JP); Kenji Kamiya, Tokyo (JP); Masahiro Ichikawa, Kanagawa (JP); Hiroto Nozaki, Tokyo (JP)

(73) Assignee: SWCC SHOWA CABLE SYSTEM CO., LTD., Tokyo (JP)

( * ) Notice: Subject to any disclaimer, the term of this patent is extended or adjusted under 35 U.S.C. 154(b) by 246 days.

(21) Appl. No.: 14/652,307

(22) PCT Filed: Dec. 9, 2013

(86) PCT No.: PCT/JP2013/007234
§ 371 (c)(1),
(2) Date: Jun. 15, 2015

(87) PCT Pub. No.: WO2014/097571
PCT Pub. Date: Jun. 26, 2014

(65) Prior Publication Data

US 2015/0332841 A1 Nov. 19, 2015

(30) Foreign Application Priority Data

Dec. 17, 2012 (JP) ..... 2012-274578

(51) Int. Cl.
*H01F 5/00* (2006.01)
*H01F 27/28* (2006.01)
(Continued)

(52) U.S. Cl.
CPC ..... *H01F 27/2823* (2013.01); *H01F 5/00* (2013.01); *H01F 5/02* (2013.01); *H01F 27/2871* (2013.01); *H01F 38/14* (2013.01)

(58) Field of Classification Search
CPC ..... H01F 5/00; H01F 27/00–27/30
(Continued)

(56) References Cited

U.S. PATENT DOCUMENTS

2001/0011413 A1* 8/2001 Yamaguchi ..... G06K 19/07749 29/600
2005/0225197 A1* 10/2005 Nagano ..... H02K 3/47 310/254.1
(Continued)

FOREIGN PATENT DOCUMENTS

JP 58106704 * 6/1986
JP 05-001115 U 1/1993
(Continued)

OTHER PUBLICATIONS

International Search Report from International Application No. PCT/JP2013/007234 dated Jan. 14, 2014.

*Primary Examiner* — Tuyen Nguyen
(74) *Attorney, Agent, or Firm* — Brundidge & Stanger, P.C.

(57) ABSTRACT

Disclosed is a litz wire coil that is configured by spirally winding a litz wire on one plane by a predetermined number of turns. The litz wire is configured by twisting together a plurality of enameled wires formed by baking an insulating film on a conducting body. Pressure shaping is performed such that the litz wire has a substantially rectangular shape in cross section, and the flatness ratio of the litz wire in cross section (long side/short side) is controlled at 1.10 to 1.60, preferably 1.20 to 1.40, more preferably 1.25 to 1.35.

3 Claims, 5 Drawing Sheets

(51) Int. Cl.
*H01F 5/02* (2006.01)
*H01F 38/14* (2006.01)

(58) Field of Classification Search
USPC ..... 336/65, 200, 232
See application file for complete search history.

(56) References Cited

U.S. PATENT DOCUMENTS

| | | | | |
|---|---|---|---|---|
| 2010/0194231 | A1* | 8/2010 | Rippel | H02K 3/47 310/213 |
| 2012/0098486 | A1* | 4/2012 | Jung | H02J 7/025 320/108 |
| 2016/0042833 | A1* | 2/2016 | Kawanishi | H01F 5/06 174/128.2 |

FOREIGN PATENT DOCUMENTS

| | | | |
|---|---|---|---|
| JP | 06-119825 | A | 4/1994 |
| JP | 2000-215972 | A | 8/2000 |
| JP | 2004-047701 | A | 2/2004 |
| JP | 2007-317914 | A | 12/2007 |
| JP | 2007-324532 | A | 12/2007 |
| JP | 2009-245658 | A | 10/2009 |

* cited by examiner

LITZ WIRE COIL

TECHNICAL FIELD

The present invention relates to a litz wire coil suitable for a non-contact power supplying system of an electromagnetic induction type.

BACKGROUND ART

In recent years, as a means for charging electric vehicles (EVs), a non-contact power supplying system of an electromagnetic induction type using coils has been studied. A non-contact power supplying system includes an electricity-feeding side coil (primary coil) to which a power is supplied from an alternating current power source, and an electricity-receiving side coil that is disposed to face the electricity-feeding side coil and is magnetically coupled to the electricity-feeding side coil. In a non-contact power supplying system for electric vehicles, an electricity-feeding side coil is disposed outside the vehicle (floor surface), and an electricity-receiving side coil is disposed inside the vehicle.

As an electricity-feeding side coil and an electricity-receiving side coil, a plane coil that is formed by spirally winding, for example, an enameled wire (a line material configured by covering a conducting body with an insulation film) on one plane is used. A plane coil is manufactured by, for example, fixing an end of the line material to a winding frame, and rotating the winding frame while applying an appropriate tensile force to the line material. When a single-core enameled wire is used for a coil line material, variations of electrical characteristics such as inductance are small, and mass-manufacturing can be achieved in a practical range.

In addition, when a large current of high frequency is required to be supplied to transmit a large power as in the case of a non-contact power supplying system for electric vehicles, a plane coil (hereinafter referred to as "litz wire coil") formed by winding a litz wire configured by twisting together multiple enameled wires (element wires) is used. One reason for this is that increase in alternating-current resistance due to the skin effect and the proximity effect specific to high frequency can be limited when a litz wire is used.

Conventionally, a litz wire coil has been proposed in which a litz wire is rolled in a tape form in such a manner as to work the wire into a rectangular shape in cross section, and then the wire is spirally wound, thereby increasing the space factor (for example, PTL 1). In the litz wire coil disclosed in PTL 1, the space factor is increased, and therefore the electric resistance is enhanced and the coil size is stabilized, and consequently, variations of inductance can be limited.

CITATION LIST

Patent Literature

PTL 1
Japanese Patent Application Laid-Open No. 2000-215972

SUMMARY OF INVENTION

Technical Problem

For the use in vehicles, household electrical appliances and the like, a litz wire coil used for a non-contact power supplying system is required to have high electrical characteristics (high inductance and low resistance) even with a limitation of the size, and it is required that variations of inductance be small. The coil inductance of a litz wire can be increased by increasing the external diameter of the coil. However, when the cross sectional flatness ratio (long side/short side) of a litz wire is excessively large as in PTL 1, the number of turns required for obtaining a desired coil external diameter is significantly large. As a result it is difficult to increase the inductance, and moreover increase in alternating-current resistance results. As described, today, a litz wire coil that is enough for general use and has high electrical characteristics while satisfying size requirement has not been achieved.

An object of the present invention is to provide a litz wire coil which has high electrical characteristics and is suitable for a non-contact power supplying system.

Solution to Problem

A litz wire coil according to an embodiment of the present invention is configured by spirally winding a litz wire on one plane by a predetermined number of turns, the litz wire being configured by twisting together a plurality of enameled wires which are each formed by baking an insulating film on a conducting body. The litz wire has a cross-sectional shape of a substantially rectangular shape, and has a flatness ratio (long side/short side) in cross section of 1.10 to 1.60.

Advantageous Effects of Invention

A litz wire coil according to an embodiment of the present invention can limit variations of electrical characteristics and reduce alternating-current resistance. Therefore, the litz wire coil according to the embodiment of the present invention is suitable for a non-contact power supplying system.

DESCRIPTION OF EMBODIMENTS

In the following, an embodiment of the present invention is described in detail with reference to the drawings.

Figure 1:
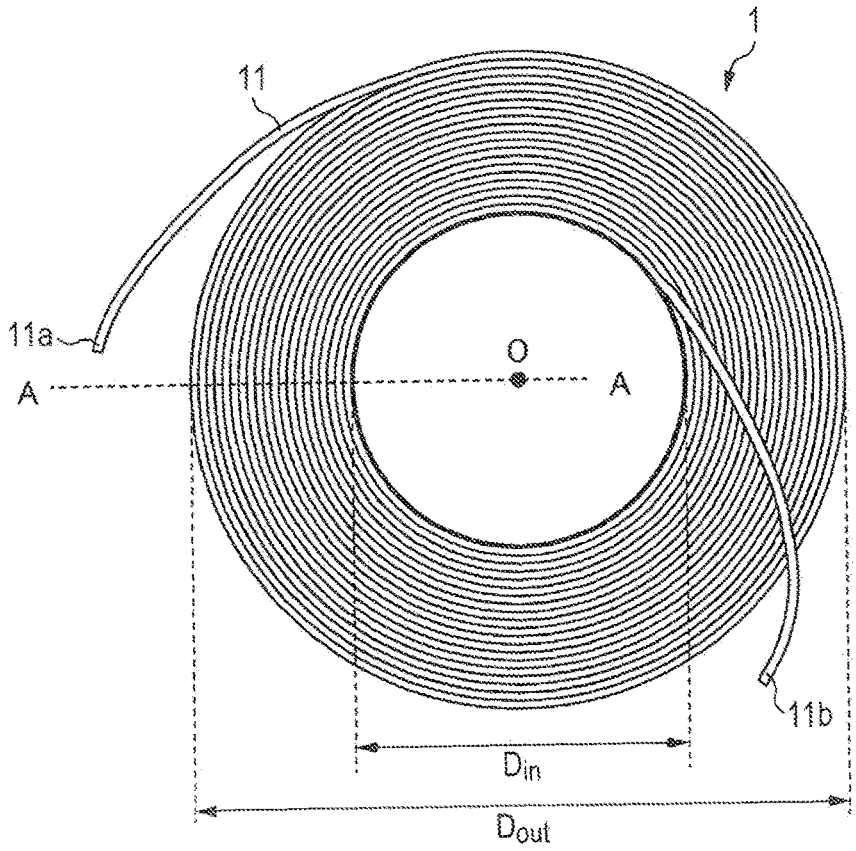
FIG. 1 illustrates a litz wire coil according to an embodiment.
Figure 2:
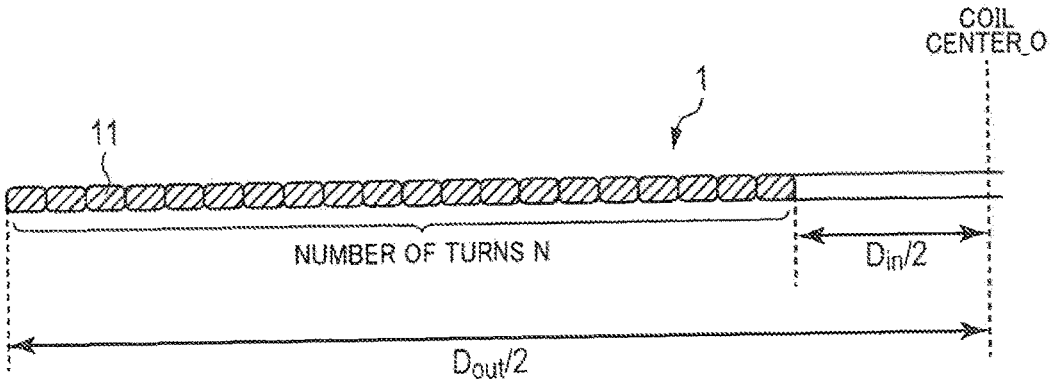
FIG. 2 illustrates the litz wire coil according to the embodiment.

FIG. 1 illustrates a litz wire coil according to an embodiment. FIG. 2 is a sectional view taken along line A-A of FIG. 1.

Litz wire coil 1 illustrated in FIGS. 1 and 2 is used as an electricity-feeding side coil or an electricity-receiving side coil of a non-contact power supplying system for electric vehicles. Litz wire coil 1 is an annular plane coil formed by spirally winding litz wire 11 on one plane by a predetermined number of turns. Litz wire coil 1 has end portions 11*a* and 11*b* that are pulled out from the outermost periphery side and the innermost periphery side, respectively. To end portions 11*a* and 11*b*, terminal metal fittings (not illustrated) are connected by soldering for example.

Litz wire 11 is configured by twisting together a plurality of enameled wires (element wires) which are each formed by baking an insulating film on a conducting body. The conducting body of the enameled wire is preferably copper or copper alloy, and it is also possible to use aluminum, aluminum alloy, a clad metal of copper and aluminum, and the like. In addition, the insulation film of the enameled wire is preferably made of a resin material which is melt by soldering of a high temperature when terminal metal fittings (not illustrated) are connected to end portions 11*a* and 11*b* of litz wire 11 by soldering, and examples of such a resin material include poly urethane, poly vinyl formal, poly urethane nylon, poly ester, poly ester nylon, poly ester imide, polyamide imide, poly ester imide/polyamide imide, polyimide and the like.

In addition, as illustrated in FIG. 2, litz wire 11 has a substantially rectangular shape in cross section. The cross-sectional flatness ratio (long side/short side) of litz wire 11 is 1.10 to 1.60, preferably 1.20 to 1.40, more preferably 1.25 to 1.35. With this configuration, the electrical characteristics are stabilized, and alternating-current resistance is reduced, thus making it possible to achieve enhancement in transmission efficiency in a non-contact power supplying system for electric vehicles.

By appropriately setting the winding condition, pressing condition, and coil design including selection of litz wire 11, it is possible to control the cross-sectional flatness ratio of litz wire 11 to fall within the above-mentioned range.

As viewed in cross section, the long side of litz wire 11 preferably extends along the radial direction of the coil. With this configuration, it is possible to achieve stable electrical characteristics and a low alternating-current resistance, and moreover, a large diameter of litz wire coil 1, that is, high inductance.

It is to be noted that a low alternating-current resistance and stable electrical characteristics can be achieved also with a configuration in which the long side of litz wire 11 in cross section extends along the thickness direction of the coil.

Preferably, litz wire coil 1 has coil internal diameter $D_{in}$ of 150 to 250 mm and coil external diameter $D_{out}$ of 350 to 600 mm, and the number of turns is 5 to 50 turns. Preferably, in litz wire 11, the diameter of the element wire is 0.04 to 0.25 mm, and the number of twisted wires is 300 to 4,000. With this configuration, stable electrical characteristics can be achieved, which is favorable for use in a non-contact power supplying system for electric vehicles.

The size of litz wire coil 1 (coil internal diameter $D_{in}$, coil external diameter $D_{out}$, and the number of turns) is properly designed such that a desired transmission efficiency is achieved in a non-contact power supplying system, and the configurations including the diameter of the element wire, the number of twisted wires, the insulating material of litz wire 11 and the like are properly selected according to litz wire coil 1 to be manufactured.

Figure 3:
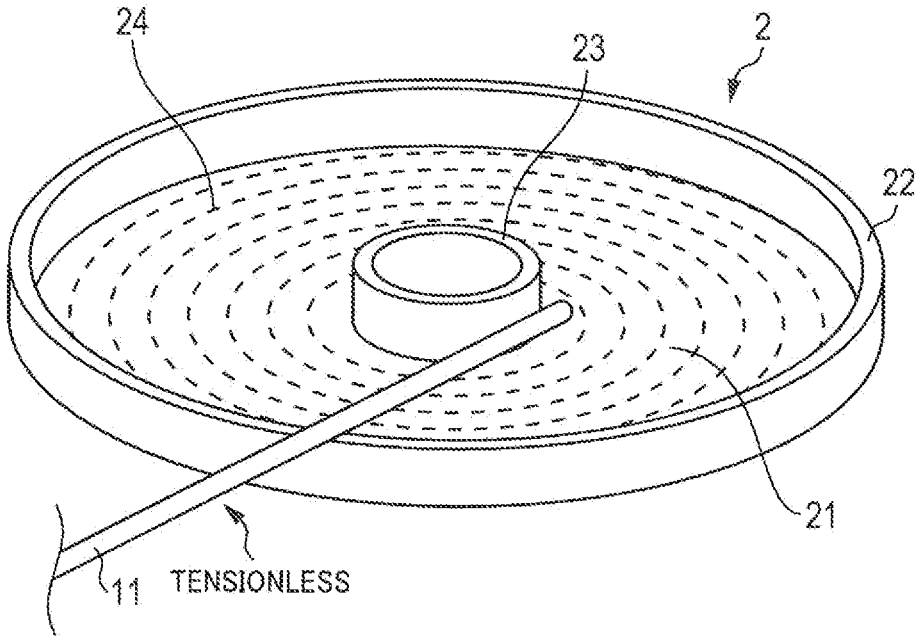
FIG. 3 illustrates a method of manufacturing (first step) the litz wire coil according to the embodiment.

Litz wire coil 1 can be manufactured by the following method for example. FIG. 3 illustrates a first step of the method of manufacturing litz wire coil 1.

As illustrated in FIG. 3, in the present embodiment, winding frame 2 is used at the first step. Winding frame 2 includes annular plane part 21, internal diameter restriction part 23 that is formed in a cylindrical shape at a center of plane part 21, and external diameter restriction part 22 that is uprightly formed at the outer peripheral edge of plane part 21. It is to be noted that internal diameter restriction part 23 may be formed in a columnar shape.

It suffices that the strength of winding frame 2 is a strength that prevents damage at a second step (pressure shaping step) described later. For example, winding frame 2 is made of an aluminum alloy or iron. The same applies to pressing member 3 for example. The size of winding frame 2 is set in accordance with litz wire coil 1 to be manufactured. That is, the external diameter of internal diameter restriction part 23 corresponds to the internal diameter of litz wire coil 1, and the internal diameter of external diameter restriction part 22 corresponds to the external diameter of litz wire coil 1.

On plane part 21, mark lines serving as marks for the winding are formed at intervals that correspond to the number of turns of litz wire coil 1. By disposing litz wire 11 along mark lines 24, it is possible to confirm whether litz wire 11 is being wound as desired, and consequently it is possible to easily achieve a designed number of turns.

At the first step, litz wire 11 in a tensionless state is fed to winding frame 2, and litz wire 11 is spirally wound on plane part 21 by a predetermined number of turns in such a manner that litz wire 11 does not overlap. To be more specific, one end of litz wire 11 is fixed to the inner periphery side (or the outer periphery side) of winding frame 2, and winding frame 2 is rotated by a predetermined rotational speed. At this time, litz wire 11 is fed in accordance with the circumferential velocity of the winding position of litz wire 11. With this configuration, litz wire 11 is fed in a tensionless state. At the first step, it is also possible to wound litz wire 11 from the 1 outer periphery side of litz wire coil to feed litz wire 11 at a tensionless state.

Figure 4:
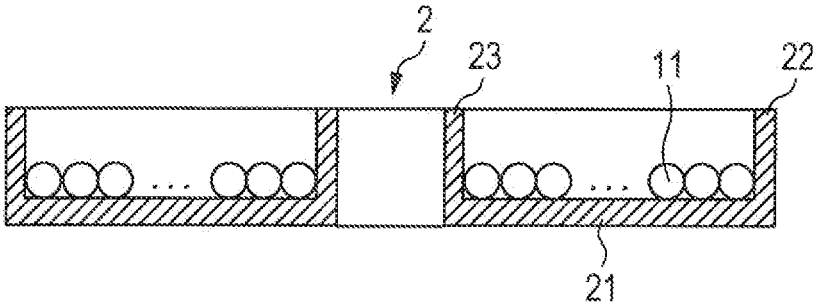
FIG. 4 illustrates an example of the arrangement of the litz wire at the first step.

When the external diameter of litz wire 11 is substantially equal to the interval of mark lines 24, litz wire 11 is wound and aligned in a substantially close contact state as illustrated in FIG. 4. In this case, the amount of deformation of litz wire 11 due to pressure shaping is small, and therefore the flatness ratio of litz wire 11 can be easily set to 1.10 to 1.60.

Figure 5:
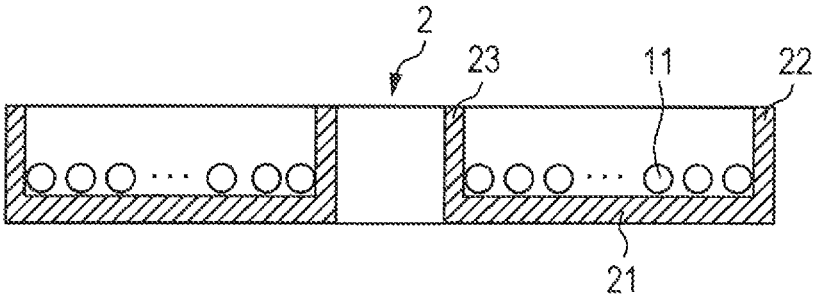
FIG. 5 illustrates another example of the arrangement of the litz wire at the first step.

When the external diameter of litz wire 11 is smaller than the interval of mark lines 24, a gap is formed between adjacent parts of litz wire 11 when litz wire 11 is wound as illustrated in FIG. 5. The smaller the external diameter of litz wire 11, or in other words, the greater the gap therebetween, the greater the flatness ratio of litz wire 11. In order to set the flatness ratio of litz wire 11 to 1.10 to 1.60, it is preferable that the gap in the radial direction of the coil be 40% or lower.

As illustrated in FIG. 4 and FIG. 5, when the external diameter of litz wire 11 is smaller than the interval of mark lines 24, litz wire 11 is flatten by the pressure shaping at a second step described later in the radial direction of the coil. That is, since the long side of litz wire 11 extends along the radial direction as viewed in cross section, and it is possible to increase the diameter of litz wire coil 1 without increasing the cross-sectional area (external diameter) of litz wire 11. Accordingly, it is possible to manufacture lightweight litz wire coil 1 having a high inductance which is suitable for a non-contact power supplying system for electric vehicles.

Figure 6:
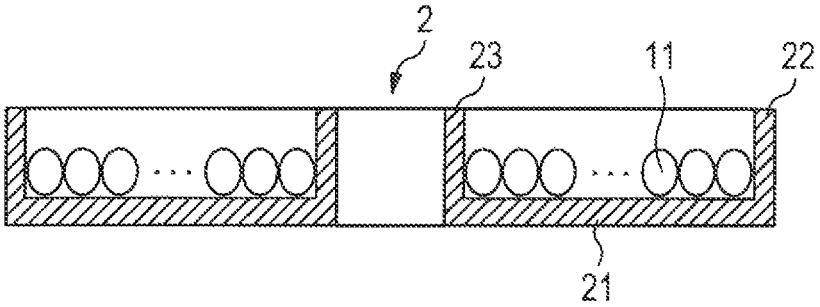
FIG. 6 illustrates another example of the arrangement of the litz wire at the first step.

It is to be noted that the external diameter of litz wire 11 may be greater than the interval of mark lines 24. In this case, as illustrated in FIG. 6, litz wire 11 is rolled and flattened in advance, and is wound in such a manner that the minor axis thereof extends along the radial direction of the coil.

In addition, it is preferable to change the feeding position of litz wire 11 in accordance with the state of progress of winding of litz wire 11. To be more specific, the feeding position of litz wire 11 can be correctly controlled by using a traversing apparatus.

The winding position of litz wire 11 changes as the number of turns increases, and therefore, when the feeding position of litz wire 11 is fixed, a tensile force may be exerted on litz wire 11. In the present embodiment, the feeding position of litz wire 11 is changed in accordance with the state of progress of the winding, and thus litz wire 11 can be surely fed in a tensionless state.

In addition, it is preferable to dispose a bonding part that temporarily fixes litz wire 11 on plane part 21 of winding frame 2. For example, a belt-shaped bonding tape serving as the bonding part is radially disposed on plane part 21. With this configuration, litz wire 11 wound on plane part 21 is temporarily fixed at that position without being displaced, and thus litz wire 11 can be easily wound as designed.

Figure 7:
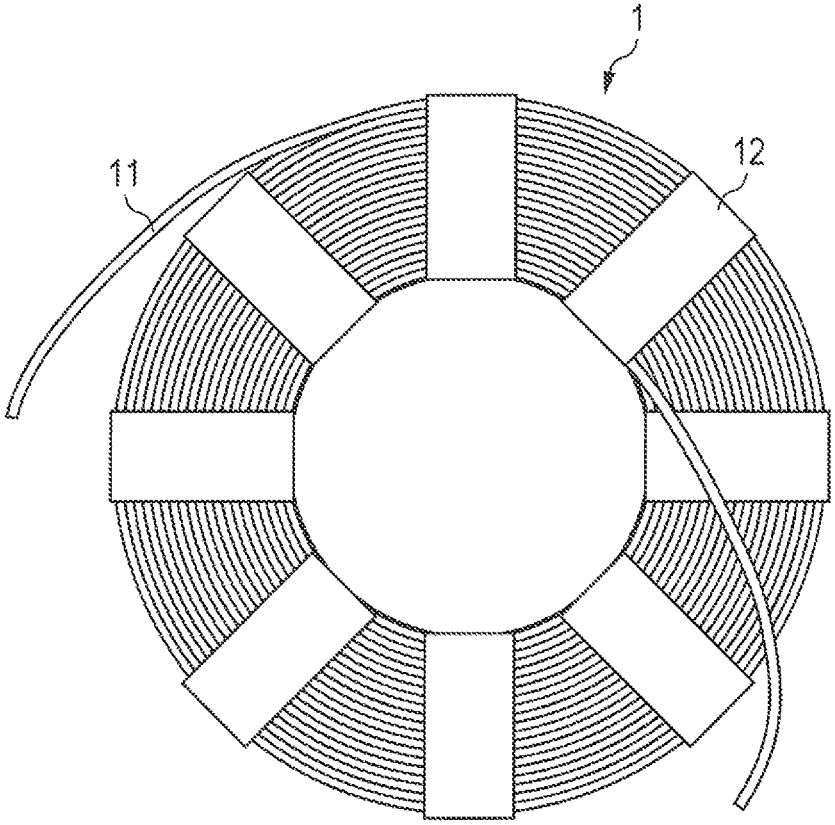
FIG. 7 illustrates another example of the litz wire coil according to the embodiment.

In addition, as illustrated in FIG. 7, when belt-shaped bonding tape 12 used as a bonding part that temporarily fixes litz wire 11 is wound in the radial direction of litz wire coil 1 after the winding (after the pressure shaping), bonding tape 12 can additionally have a function of maintaining the coil shape.

In the state where litz wire 11 has been wound at a first step (winding step), deviation of litz wire 11, a gap between litz wire 11, separation of litz wire 11 and the like still remain. That is, such a state is a state where many defects remain as a coil, and is not a state of a flat and stable coil shape. Therefore, a second step (pressure shaping) is performed to obtain a desired shape of litz wire coil 1.

Figure 8:
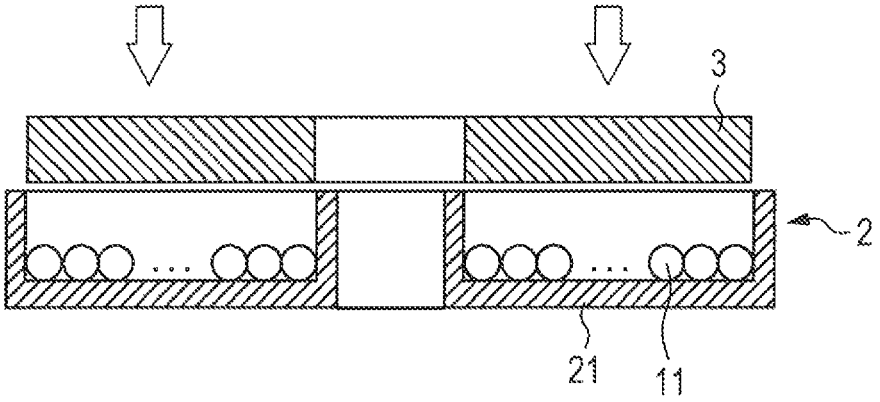
FIG. 8 illustrates a method of manufacturing (second step) the litz wire coil according to the embodiment.

FIG. 8 illustrates the second step of the method of manufacturing litz wire coil 1 according to the embodiment.

Figure 9:
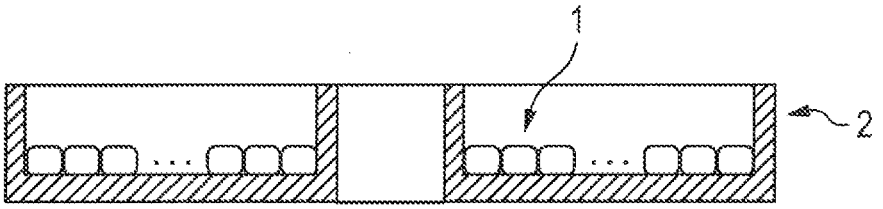
FIG. 9 illustrates a cross-sectional shape of the litz wire coil after the second step.

As illustrated in FIG. 8, in the present embodiment, litz wire 11 wound on plane part 21 is pressure-shaped in the thickness direction with a predetermined pressure by pressing member 3 having an annular shape corresponding to plane part 21 of winding frame 2 at the second step. At the second step, litz wire 11 wound on plane part 21 is pressure-shaped in the thickness direction (flattened in the radial direction), and thus litz wire 11 is formed in a rectangular shape in cross section as illustrated in FIG. 9.

The pressing force at the second step is adjusted in accordance with a required coil accuracy. For example, when the pressing force at the second step is set to 0.1 MPa or greater, the irregularity and gap between parts of the element wire can be eliminated. In addition, when the pressing force is set to 0.5 MPa or greater, the entire coil can be sufficiently planarized. Furthermore, when the pressing force is set to 5.0 MPa or greater, it is possible to cause plastic deformation of a part of the element wire so as to increase the space factor.

In order to maintain the coil shape of pressure-shaped litz wire coil 1, a predetermined process is performed on litz wire coil 1.

For example, as described above, a belt-shaped bonding tape is wound in the radial direction of the coil to fix the coil shape.

In addition, for example, it is possible to adopt a configuration in which litz wire 11 is composed of a self-welding line (an enameled wire having a surface layer that exhibits a bonding force at the time of heating), and a heat at a fusing temperature of the self-welding line is applied at the time of the pressure shaping, or after the pressure shaping, to firmly fix the litz wire.

In addition, it is also possible to apply an adhesive agent to the entirety of litz wire coil 1 to fix the coil shape for example. In this case, it is preferable to preliminary apply a releasing agent to winding frame 2.

In addition, for example, it is also possible to immerse litz wire coil 1 in impregnation varnish to fix the coil shape.

As described, the method of manufacturing litz wire coil 1 according to the present embodiment includes a first step (winding step) and a second step (pressure shaping step). In the first step, litz wire 11 in a tensionless state is fed to winding frame 2 that includes annular plane part 21, internal diameter restriction part 23 formed in a cylindrical shape or a columnar shape at the center of plane part 21, and external diameter restriction part 22 uprightly formed at the outer peripheral edge to spirally wound litz wire 11 on plane part 21 by a predetermined the number of turns. In the second step, by pressing member 3 having a shape corresponding to plane part 21, litz wire 11 wound on plane part 21 is pressure-shaped in the thickness direction with a predetermined pressure.

With this manufacturing method, the coil shape is highly accurately controlled, and thus it is possible to stably mass-manufacture litz wire coil 1 suitable for a non-contact power supplying system for electric vehicles in which variations of electrical characteristics (inductance, in particular) are significantly small. In addition, since the coil is entirely integrated, the coil can be easily handled when it is incorporated in a predetermined apparatus (for example, a non-contact power supplying system for electric vehicles).

Examples

In Examples, under the condition where coil internal diameter is 200 mm and the number of turns is 35 turns, a litz wire was wound by the manufacturing method of the embodiment to produce a litz wire coil. The external diameter of the coil was adjusted such that the flatness ratio of the litz wire in cross section is 1.10 to 1.60. In Example 1, a litz wire in which the diameter of the element wire is 0.20 mm and the number of twisted is 400 (cross-sectional area: 12.6 $mm^2$) was used. In Example 2, a litz wire in which the diameter of the element wire is 0.11 mm and the number of twisted wires is 1,300 (cross-sectional area: 12.4 $mm^2$) was used.

Comparative Examples

In comparative examples, under the condition where the coil internal diameter is 200 mm and the number of turns is 35 turns, a litz wire was wound by the manufacturing method of the embodiment to produce a litz wire coil. The external diameter of the coil was adjusted such that the flatness ratio of the litz wire in cross section does not fall within a range of 1.10 to 1.60. In addition, in addition to the litz wire used in the above-mentioned Examples, a litz wire in which the diameter of the element wire is 0.14 mm and the number of the twisted wires is 600 (cross-sectional area: 9.2 $mm^2$) was used.

In each of litz wire coils produced in Examples and Comparative Examples, the alternating-current resistance value and the inductance at 50 kHz were measured to evaluate the electrical characteristics. Evaluations are shown in Tables 1 to 3.

It is to be noted that the alternating-current resistance values in Tables 1 to 3 are each the average value (mΩ) of 10 litz wire coils produced in the same manner. In addition, variations of inductance are values (%) obtained by computing {(Maximum value)−(Minimum value)}/(Average value) based on results of measurement of 10 litz wire coils produced in the same manner. Further, since variations of inductance is required to be 1% or below for mass-manufacturing, 1% is used as an evaluation criteria.

1% or below (Examples 1 and 2). In particular, when the flatness ratio of the litz wire in cross section is 1.20 to 1.40, the alternating-current resistance was especially low (Examples 1-2 to 1-5, and 2-2 to 2-5), and further, when the flatness ratio of the litz wire in cross section is 1.25 to 1.35, the variations of inductance were further reduced (Examples 1-3, 1-4, 2-3 and 2-4).

TABLE 1

| | Example | | | | | | |
|---|---|---|---|---|---|---|---|
| | 1-1 | 1-2 | 1-3 | 1-4 | 1-5 | 1-6 | 1-7 |
| Detail of litz wire Diameter of element wire [mm]/Number of twist | 0.20/400 | | | | | | |
| Flatness ratio (Long side/Short side) | 1.12 | 1.22 | 1.25 | 1.31 | 1.37 | 1.45 | 1.45 |
| Resistance of alternating-current [mΩ] | 135 | 123 | 122 | 121 | 123 | 139 | 140 |
| Variations of inductance [%] | 0.85 | 0.84 | 0.77 | 0.78 | 0.84 | 0.86 | 0.85 |
| Comprehensive evaluation | C | B | A | A | B | C | C |

A: Significantly favorable,
B: Very favorable,
C: Favorable,
D: Practical problems can be caused

TABLE 2

| | Example | | | | | | |
|---|---|---|---|---|---|---|---|
| | 2-1 | 2-2 | 2-3 | 2-4 | 2-5 | 2-6 | 2-7 |
| Detail of litz wire Diameter of element wire [mm]/Number of twist | 0.11/1300 | | | | | | |
| Flatness ratio (Long side/Short side) | 1.11 | 1.24 | 1.26 | 1.30 | 1.38 | 1.46 | 1.45 |
| Resistance of alternating-current [mΩ] | 137 | 124 | 121 | 120 | 125 | 138 | 140 |
| Variations of inductance [%] | 0.86 | 0.83 | 0.76 | 0.77 | 0.83 | 0.85 | 0.86 |
| Comprehensive evaluation | C | B | A | A | B | C | C |

A: Significantly favorable,
B: Very favorable,
C: Favorable,
D: Practical problems can be caused

TABLE 3

| | Comparative Example | | | | | |
|---|---|---|---|---|---|---|
| | 1 | 2 | 3 | 4 | 5 | 6 |
| Detail of litz wire Diameter of element wire [mm]/Number of twist | 0.11/1300 | 0.14/600 | 0.20/400 | 0.20/400 | 0.11/1300 | 0.14/600 |
| Flatness ratio (Long side/Short side) | 1.00 | 1.00 | 1.00 | 1.65 | 1.70 | 1.70 |
| Resistance of alternating-current [mΩ] | 193 | 191 | 199 | 185 | 196 | 196 |
| Variations of inductance [%] | 1.12 | 1.08 | 1.19 | 1.15 | 1.21 | 1.16 |
| Comprehensive evaluation | D | D | D | D | D | D |

A: Significantly favorable,
B: Very favorable,
C: Favorable,
D: Practical problems can be caused As shown in Tables 1 to 3, when the flatness ratio of the litz wire in cross section is 1.10 to 1.60, the alternating-current resistance was low, and variations of inductance was While the invention made by the present inventor has been specifically described based on the preferred embodiments, it is not intended to limit the present invention to the above-mentioned preferred embodiments but the present invention may be further modified within the scope and spirit of the invention defined by the appended claims.

For example, the shape of the litz wire coil is not limited to the annular shape, and may be an elliptical annular shape or a square-annular shape.

The embodiment disclosed herein is merely an exemplification and should not be considered as limitative. The scope of the present invention is specified by the following claims, not by the above-mentioned description. It should be understood that various modifications, combinations, sub-combinations and alterations may occur depending on design requirements and other factors in so far as they are within the scope of the appended claims or the equivalents thereof.

This disclosure of Japanese Patent Application No. 2012-274578, filed on Dec. 17, 2012, including the specification, drawings and abstract, is incorporated herein by reference in its entirety.

REFERENCE SIGNS LIST

1 Litz wire coil
11 Litz wire

The invention claimed is:

1. A litz wire coil that is configured by spirally winding a litz wire on one plane by a predetermined number of turns, the litz wire being configured by twisting together a plurality of enameled wires which are each formed by baking an insulating film on a conducting body, wherein:

the litz wire has a cross-sectional shape of a substantially rectangular shape, and has a flatness ratio (long side/short side) in cross section of 1.10 to 1.60, in the litz wire, 300 to 4,000 element wires are twisted together and each element wire has a diameter of 0.04 to 0.25 mm, an internal diameter of the coil is 150 to 250 mm, an external diameter of the coil is 350 to 600 mm, the litz wire is wound by 5 to 50 turns, and the long side of the litz wire in cross section extends along a radial direction of the coil.

2. The litz wire coil according to claim 1, wherein the flatness ratio (long side/short side) of the litz wire in cross section is 1.20 to 1.40.

3. The litz wire coil according to claim 2, wherein the flatness ratio (long side/short side) of the litz wire in cross section is 1.25 to 1.35.

* * * * *